US012280932B2

(12) United States Patent
Boukredine et al.

(10) Patent No.: US 12,280,932 B2
(45) Date of Patent: Apr. 22, 2025

(54) CARTON AND BLANK THEREFOR

(71) Applicant: WestRock Packaging Systems, LLC, Atlanta, GA (US)

(72) Inventors: Eric Boukredine, Ambrault (FR); Julien D. Merzeau, Chateauroux (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 27 days.

(21) Appl. No.: 18/029,824

(22) PCT Filed: Oct. 2, 2021

(86) PCT No.: PCT/US2021/053277
§ 371 (c)(1),
(2) Date: Mar. 31, 2023

(87) PCT Pub. No.: WO2022/072911
PCT Pub. Date: Apr. 7, 2022

(65) Prior Publication Data

US 2023/0406588 A1 Dec. 21, 2023

Related U.S. Application Data

(60) Provisional application No. 63/086,863, filed on Oct. 2, 2020.

(51) Int. Cl.
*B65D 71/36* (2006.01)

(52) U.S. Cl.
CPC .... *B65D 71/36* (2013.01); *B65D 2571/00197* (2013.01); *B65D 2571/0045* (2013.01);
(Continued)

(58) Field of Classification Search
CPC ..... B65D 71/36; B65D 2571/00791; B65D 2571/0045; B65D 2571/0066; B65D 2571/00728; B65D 71/30; B65D 71/0051
(Continued)

(56) References Cited

U.S. PATENT DOCUMENTS 3,807,624 A 4/1974 Funkhouser
4,216,861 A 8/1980 Oliff
(Continued)

FOREIGN PATENT DOCUMENTS

EP 0475147 A1 3/1992

OTHER PUBLICATIONS

International Search Report issued in PCT/US2021/053277, dated Jan. 26, 2022.

*Primary Examiner* — Steven A. Reynolds
(74) *Attorney, Agent, or Firm* — Brian J. Goldberg; Tsugihiko Suzuki; Rohini K. Garg

(57) ABSTRACT

Aspects of the disclosure relate to a carton for packaging one or more articles, a blank for forming the carton and a method of packaging articles. The carton (90) comprises a plurality of primary panels (12, 14, 16, 18, 20) for forming a tubular structure and an end closure structure for at least partially closing an end of the tubular structure. The primary panels (12, 14, 16, 18, 20) include a top panel (16). The end closure structure comprises a top end closure flap (28A/28C) having a handle opening, a first side end closure flap (24A), and a web panel (26A) coupling the top end closure flap (28A/28C) with the first side end closure flap (24A). The web panel 26A is hingedly connected to the top end closure flap (28A/28C) as well as to the first side end closure flap (24A). The top end closure flap (28A/28C) is connected to the top panel (16) by at least one corner panel (40A, 40B, 40C).

21 Claims, 5 Drawing Sheets

(52) U.S. Cl.
CPC ..... *B65D 2571/0066* (2013.01); *B65D 2571/00728* (2013.01)

(58) Field of Classification Search
USPC ..... 206/427, 434
See application file for complete search history.

(56) References Cited

U.S. PATENT DOCUMENTS

| | | | | |
|---|---|---|---|---|
| 6,202,920 | B1 | 3/2001 | Auclair | |
| 6,536,656 | B2 * | 3/2003 | Auclair | B65D 71/36 206/427 |
| 7,644,817 | B2 * | 1/2010 | Sutherland | B65D 71/36 206/139 |
| 11,325,764 | B2 * | 5/2022 | Spivey, Sr. | B65D 71/34 |
| 2005/0269387 | A1 * | 12/2005 | Sutherland | B65D 71/36 206/427 |
| 2011/0065558 | A1 * | 3/2011 | Smalley | B65D 71/36 493/162 |
| 2011/0284622 | A1 * | 11/2011 | Boukredine | B65D 71/36 206/429 |
| 2012/0279897 | A1 * | 11/2012 | Schmal | B65D 71/36 206/593 |
| 2020/0189816 | A1 | 6/2020 | Zacherle | |
| 2022/0185561 | A1 * | 6/2022 | Leite | B65D 71/30 |

* cited by examiner

CARTON AND BLANK THEREFOR

CROSS REFERENCE TO RELATED APPLICATIONS

This application is a U.S. 371 National Phase Patent Application of International PCT Patent Application No. PCT/US2021/053277, filed on Oct. 2, 2021, which application claims the benefit of priority to U.S. Provisional Patent Application No. 63/086,863, filed on Oct. 2, 2020. The entire contents of these applications are incorporated herein by reference in their entirety.

TECHNICAL FIELD

The present invention relates to cartons and to blanks for forming the same. More specifically, but not exclusively, the invention relates to a carrier of the wrap-around type having an end closure structure for retention of an article therein.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide article carriers or cartons in which an end closure structure is provided to retain an article within the carton.

The present invention seeks to provide an improvement in the field of cartons, typically formed from paperboard or the like.

SUMMARY

A first aspect of the invention provides a carton for packaging one or more articles. The carton comprises a plurality of panels forming walls of a tubular structure including a top wall and first and second side walls. The carton comprises an end closure structure for at least partially closing an end of the tubular structure. The end closure structure comprises a top end closure flap having a handle flap which defines at least in part a handle opening in the top end closure flap for forming a carrying handle. The end closure structure comprises a side end closure flap coupled to one of the first and second side walls and a web panel coupling the top end closure flap to the first side end closure flap. The web panel is hingedly connected to the top end closure flap and is hingedly connected to the first side end closure flap. The top end closure flap is connected to the top panel by at least one corner panel.

Optionally, the carton comprises a folding structure coupling the top end closure flap to the top panel, the folding structure including the at least one corner panel, the folding structure being folded so as to bear against the endmost articles so as to inhibit movement of at least one article disposed adjacent thereto.

Optionally, the at least one corner panel is configured to bear against an upper end of an adjacent article.

Optionally, an upper region of each of the first and second side walls is displaced inwardly with respect to a lower region of the respective first and second side wall.

Optionally, the top wall of the carton is shorter than the base wall in a longitudinal direction parallel to a tubular axis of the tubular structure formed by the plurality of panels.

Optionally, the top wall of the carton is shorter than the base wall in a transverse direction perpendicular to a tubular axis of the tubular structure formed by the plurality of panels.

Optionally, the side end closure flap comprises a first upper side end closure flap and a first lower side end closure flap together defining a dust flap.

Optionally, the side end closure flap comprises a slot which is defined by a pair of opposing longitudinal edges both sloping downwardly toward a fold line hinging said side end closure flap to said one of the first and second side walls.

Optionally, the carton comprises a second end closure structure for at least partially closing a second end of the tubular structure, the second end closure structure comprising a second side end closure flap hingedly connected to a second end of said one of the first and second side walls.

Optionally, the second side end closure flap comprises a second upper side end closure flap and a second lower side end closure flap together defining a second dust flap.

Optionally, the second side end closure flap comprises a slot which is defined by a second pair of opposing longitudinal edges both sloping downwardly toward a second fold line hinging said second side end closure flap to said one of the first and second side walls.

Optionally, the side end closure flap is hingedly connected to the first side wall by a linear fold line extending between corners of the first side wall.

Optionally, the first lower side end closure flap is hingedly connected to the first side wall by a first linear fold line and the first upper side end closure flap is hingedly connected to the first side wall by a second linear fold line, the first and second linear fold lines being colinear with each other.

Optionally, the first side wall comprises a filleted upper corner and filleted lower corner and the linear fold line extends between the filleted upper corner and the filleted lower corner.

A second aspect of the invention provides a carton for packaging one or more articles. The carton comprises a plurality of panels for forming walls of a tubular structure. The plurality of panels includes a top panel. The carton comprises an end closure structure for at least partially closing an end of the tubular structure. The end closure structure comprises a top end closure flap, a first side end closure flap, and a web panel. The web panel couples the top end closure flap to the first side end closure flap. The web panel is hingedly connected to the top end closure flap and is hingedly connected to the first side end closure flap. The top end closure flap is connected to the top panel by at least one corner panel. The top end closure flap is disposed at least partially overlaying an outside surface of the first side end closure flap.

A third aspect of the invention provides a carton for packaging one or more articles. The carton comprises a plurality of panels for forming walls of a tubular structure. The plurality of panels includes a top panel. The carton comprises an end closure structure for at least partially closing an end of the tubular structure. The end closure structure comprises a top end closure flap, a first side end closure flap, and a web panel. The web panel couples the top end closure flap to the first side end closure flap. The web panel is hingedly connected to the top end closure flap and is hingedly connected to the first side end closure flap by a first fold line. The top end closure flap is connected to the top panel by at least one corner panel. The at least one corner panel has at least one intermediate fold line extending at least partially across the corner panel. The at least one intermediate fold line is disposed at an acute angle with respect to the first fold line.

A fourth aspect of the invention provides a carton for packaging one or more articles. The carton comprises a plurality of panels for forming walls of a tubular structure. The plurality of panels includes a top panel and a first side panel. The carton comprises an end closure structure for at least partially closing an end of the tubular structure. The end closure structure comprises a top end closure flap, a first side end closure flap, and a web panel. The web panel couples the top end closure flap to the first side end closure flap. The web panel is hingedly connected to the top end closure flap and is hingedly connected to the first side end closure flap. The top end closure flap is connected to the top panel by at least one corner panel. The first side panel has a rounded corner edge along which the at least one corner panel is conformingly disposed.

A fifth aspect of the invention provides a blank for forming a carton. The blank comprises a plurality of panels for forming walls of a tubular structure including a top wall and first and second side walls. The blank comprises panels for forming an end closure structure for at least partially closing an end of the tubular structure. The end closure structure comprises a top end closure flap having a handle flap which defines at least in part a handle opening in the top end closure flap for forming a carrying handle. The end closure structure comprises a side end closure flap coupled to one of the first and second side walls and a web panel coupling the top end closure flap to the first side end closure flap. The web panel is hingedly connected to the top end closure flap and is hingedly connected to the first side end closure flap. The top end closure flap is connected to the top panel by at least one corner panel.

A sixth aspect of the invention provides a blank for forming a carton. The blank comprises a plurality of panels for forming walls of a tubular structure including a top wall and first and second side walls. The blank comprises panels for forming an end closure structure for at least partially closing an end of the tubular structure. The end closure structure comprises a top end closure flap, a first side end closure flap, and a web panel. The web panel couples the top end closure flap to the first side end closure flap. The web panel is hingedly connected to the top end closure flap and is hingedly connected to the first side end closure flap. The top end closure flap is connected to the top panel by at least one corner panel. The top end closure flap is arranged to be disposed at least partially overlaying an outside surface of the first side end closure flap in a setup carton.

A seventh aspect of the invention provides a blank for forming a carton. The blank comprises a plurality of panels for forming walls of a tubular structure including a top wall and first and second side walls. The blank comprising panels for forming an end closure structure for at least partially closing an end of the tubular structure. The end closure structure comprises a top end closure flap, a first side end closure flap, and a web panel. The web panel couples the top end closure flap to the first side end closure flap. The web panel is hingedly connected to the top end closure flap and is hingedly connected to the first side end closure flap by a first fold line. The top end closure flap is connected to the top panel by at least one corner panel. The at least one corner panel has at least one intermediate fold line extending at least partially across the corner panel. The at least one intermediate fold line is disposed at an acute angle with respect to the first fold line.

An eighth aspect of the invention provides a blank for forming a carton. The blank comprises a plurality of panels for forming walls of a tubular structure including a top wall and first and second side walls. The blank comprises panels for forming an end closure structure for at least partially closing an end of the tubular structure. The end closure structure comprises a top end closure flap, a first side end closure flap, and a web panel. The web panel couples the top end closure flap to the first side end closure flap. The web panel is hingedly connected to the top end closure flap and is hingedly connected to the first side end closure flap. The top end closure flap is connected to the top panel by at least one corner panel. The first side panel has a rounded corner edge along which the at least one corner panel is conformingly disposed in a setup carton.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
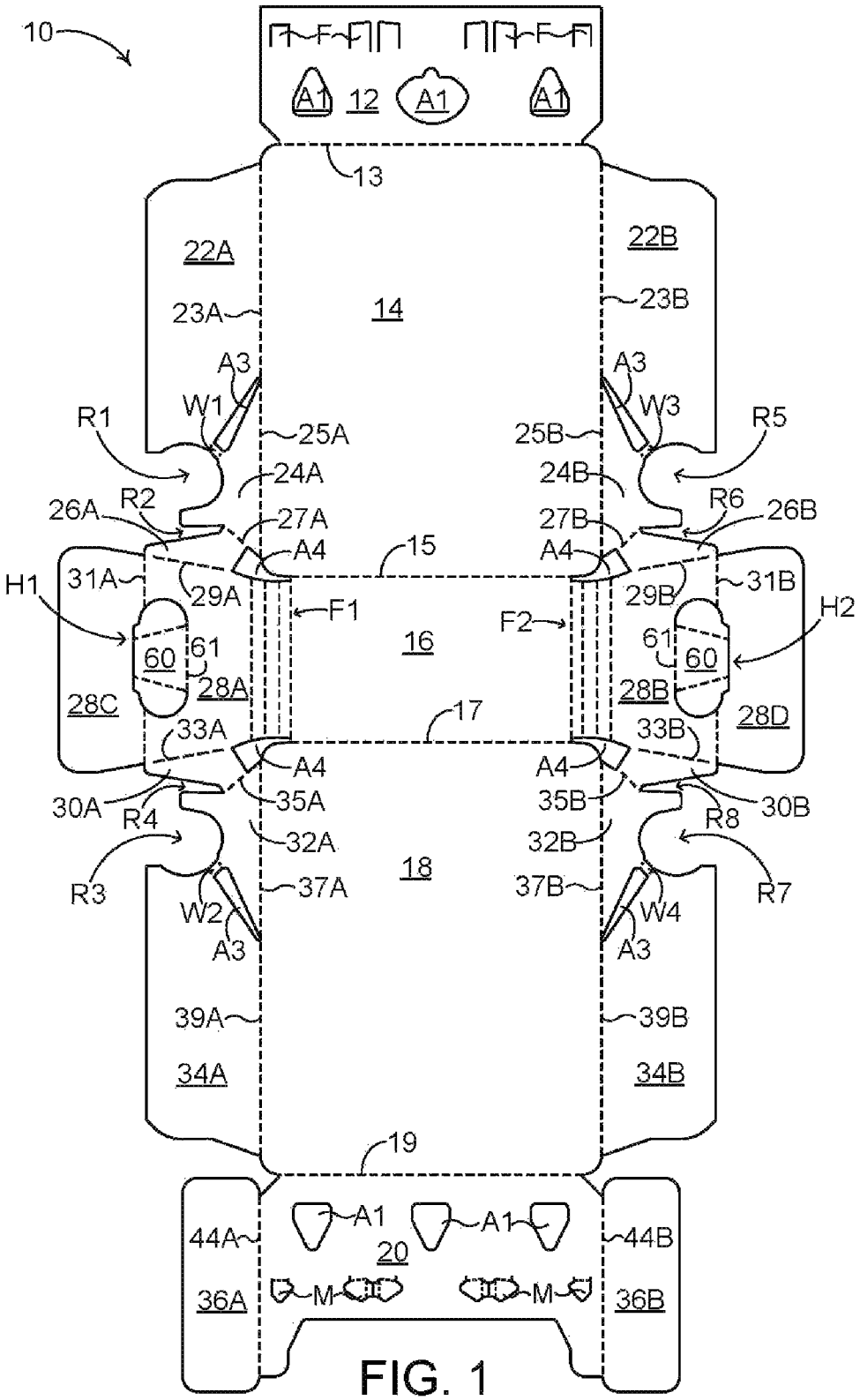
FIG. 1 is a plan view from above of a blank for forming a carton according to a first embodiment.
Figure 2:
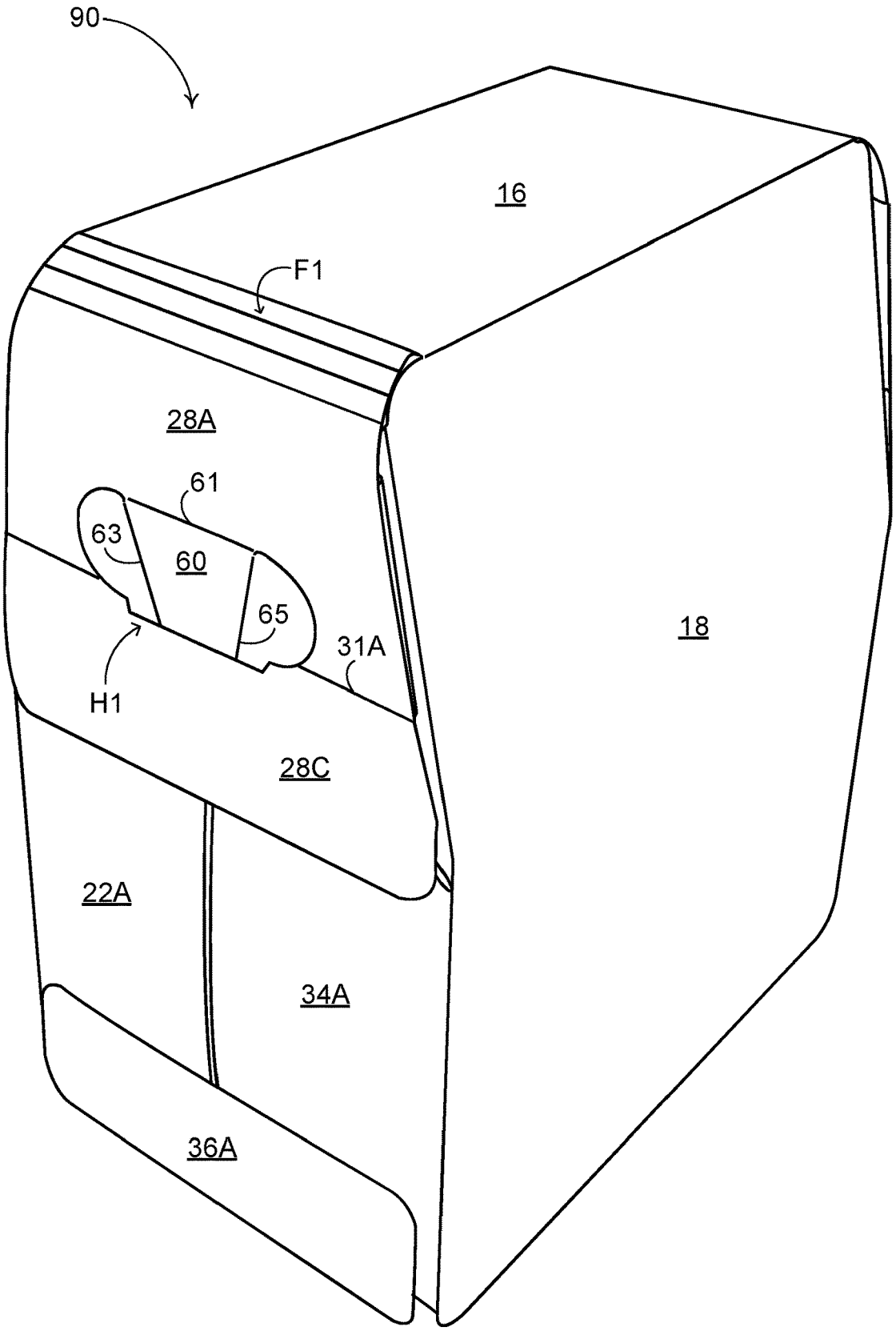
FIG. 2 is a perspective view from above of a carton formed from the blank of FIG. 1.

Referring to FIG. 1, there is shown a plan view of a blank 10 capable of forming a carton or carrier 90, as shown in FIG. 2, for containing and carrying a group of primary products such as, but not limited to, bottles or cans, hereinafter referred to as articles (not shown). The blank 10 forms a secondary package for packaging at least one primary product container or package.

In the embodiments detailed herein, the terms "carton" and "carrier" refer, for the non-limiting purpose of illustrating the various features of the invention, to a container 90 for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structures or cartons 90 described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiment, the blank 10 is configured to form a carton or carrier 90 for packaging an exemplary arrangement of exemplary articles. In the embodiment illustrated the arrangement is a 3×2 matrix or array; in the illustrated embodiment two rows of three articles are provided, and the articles are 12 oz (approx. 355 ml) glass bottles. Alternatively, the blank 10 can be configured to form a carrier for packaging other types, number and size of articles and/or for packaging articles in a different arrangement or configuration.

Turning to FIG. 1, there is illustrated a blank 10 for forming a carton 90 according to a first embodiment. The blank 10 comprises a plurality of main panels 12, 14, 16, 18, 20 for forming a tubular structure. The plurality of main panels 12, 14, 16, 18, 20 comprises a first base panel 12, a first side panel 14, a top panel 16, a second side panel 18, and a second base panel 20. The plurality of panels 12, 14, 16, 18, 20 may be arranged in a linear series hinged one to the next by corresponding fold lines 13, 15, 17, 19.

The blank 10 is foldable to form a package 90 as illustrated in FIG. 2. The first and second base panels 12, 20 are engageable with one another in an overlapping relationship to form a composite base wall 12/20 of the carton 90. The blank 10 may comprise a complementary locking mechanism for securing the second base panel 20 to the first base panel 12. The first base panel 12 may comprise at least one first part F of the complementary locking mechanism. The second base panel 20 may comprise at least one second part M of the complementary locking mechanism. In the illustrated embodiment, the first base panel 12 comprises a plurality of female tabs F defining openings in the first base panel 12. The second base panel 20 comprises a plurality of male tabs M, the openings in the first base panel 12 being configured to receive a respective one of the male tabs M. The female tabs F are arranged to be displaced out of the first base panel 12 to form the opening and to bear against the male tabs M when received therein.

The first and second base panels 12, 20 may comprise at least one first aperture A1. In the illustrated embodiment, each of the first and second base panels 12, 20 comprises three first apertures A1. The first apertures A1 may be employed to facilitate construction of the carton 90. A packaging machine component may engage with the first apertures A1 to enable the plurality of panels 12, 14, 16, 18, 20 to be tightened about a group of articles. The first apertures A1 may also be employed to facilitate alignment of the first and second base panels 12, 20 with respect to each other or to align the first part of the complementary locking mechanism with the second part of the complementary locking mechanism. The complementary locking mechanism illustrated and described is entirely optional.

The blank 10 comprises at least one end closure structure for at least partially closing an end of a tubular structure defined by the plurality of panels 12, 14, 16, 18, 20.

In the illustrated embodiment an end closure structure is provided for at least partially closing each end of the tubular structure.

The blank 10 comprises a first end closure structure comprising a plurality of end closure panels 22A, 24A, 26A, 28A, 28C, 30A, 32A, 34A, 36A.

The first end closure structure comprises a first upper top end closure flap 28A hingedly connected to the top panel 16 by a fold line arrangement (also referred to herein as a folding structure) F1 described in further detail below. A first lower top end closure flap 28C is hingedly connected to the first upper top end closure flap 28A by a hinged connection in the form of a fold line 31A. The first upper top end closure flap 28A and the first lower top end closure flap 28C together form or define a first top end closure flap 28A/28C. The first upper top end closure flap 28A forms a proximal portion of the first top end closure flap 28A/28C disposed adjacent to the top panel 16. The first lower top end closure flap 28C forms a distal glue flap portion of the first top end closure flap 28A/28C.

The first end closure structure comprises a first upper side end closure flap 24A hingedly connected to the first side panel 14 by a hinged connection in the form of a fold line 25A.

Optionally, a first web panel 26A is hingedly connected to the first upper top end closure flap 28A along a first side edge thereof by a hinged connection in the form of a fold line 29A. The first web panel 26A may be hingedly connected to the first upper side end closure flap 24A by a hinged connection in the form of a fold line 27A.

The first upper side end closure flap 24A may be coupled to a first lower side end closure flap 22A by a first gusset panel W1.

The first lower side end closure flap 22A is hingedly connected to the first side panel 14 by a hinged connection in the form of a fold line 23A.

A first relief aperture A3 separates the first lower side end closure flap 22A from the first upper side end closure flap 24A. The first relief aperture A3 extends between the first side panel 14 and the first gusset panel W1. The first relief aperture A3 may be substantially triangular in shape, in other embodiments the first relief aperture A3 may be substantially slot shaped. The first relief aperture A3 may substantially take the form of an isosceles triangle. A vertex or corner of the first relief aperture A3 lies upon or interrupts the hinged connection between first lower side end closure flap 22A and the first side panel 14. The first relief aperture A3 is generally inclined with respect to a side edge of the first side panel 14. A second and a third vertex of the first relief aperture A3 are disposed in closer proximity to the first upper top end closure flap 28A than the first vertex.

The first end closure structure comprises a first recess or cutaway R1 struck, or defined, in part in the first lower side end closure flap 22A and struck, or defined, in part in the first upper side end closure flap 24A.

The first end closure structure comprises a second recess or cutaway R2 struck, or defined between the first upper side end closure flap 24A and the first web panel 26A.

An optional second relief aperture A4 is provided proximate a first corner of the top panel 16. The first relief aperture A4 defines a portion of the first side edge of the first upper top end closure flap 28A, and forms a free side edge thereof. That is to say, said portion of the first side edge of the first upper top end closure flap 28A is not hinged to another panel. The relief aperture A4 spaces the first web panel 26A from the first corner of the top panel 16. The relief aperture A4 spaces apart the first upper top end closure flap 28A and the first upper side end closure flap 24A.

The first end closure structure may comprise a second upper side end closure flap 32A hingedly connected to the second side panel 18 by a hinged connection in the form of a fold line 37A.

Optionally, a second web panel 30A is hingedly connected to the first upper top end closure flap 28A along a second side edge thereof by a hinged connection in the form of a fold line 33A. The second side edge of the first upper top end closure flap 28A opposes the first side edge of the first upper top end closure flap 28A.

The second web panel 30A may be hingedly connected to the second upper side end closure flap 32A by a hinged connection in the form of a fold line 35A.

The second upper side end closure flap 32A may be coupled to a second lower side end closure flap 34A by a second gusset panel W2.

The second lower side end closure flap 34A is hingedly connected to the second side panel 18 by a hinged connection in the form of a fold line 39A.

A first relief aperture A3 separates the second lower side end closure flap 34A from the second upper side end closure flap 32A. The first relief aperture A3 extends between the second side panel 18 and the second gusset panel W2. The first relief aperture A3 may be substantially triangular in shape, in other embodiments the first relief aperture A3 may be substantially slot shaped. The first relief aperture A3 may substantially take the form of an isosceles triangle. A first vertex or corner of the first relief aperture A3 lies upon, or interrupts, the hinged connection between second lower side end closure flap 34A and the second side panel 18. The first relief aperture A3 is generally inclined with respect to a side edge of the second side panel 18. A second and a third vertex of the first relief aperture A3 are disposed in closer proximity to the first upper top end closure flap 28A than the first vertex.

An optional second relief aperture A4 is provided proximate a second corner of the top panel 16. The relief aperture A4 defines a portion of the second side edge of the first upper top end closure flap 28A, and forms a free side edge thereof. That is to say, said portion of the second side edge of the first upper top end closure flap 28A is not hinged to another panel. The relief aperture A4 spaces the second web panel 30A from the second corner of the top panel 16. The relief aperture A4 spaces apart the first upper top end closure flap 28A and the second upper side end closure flap 32A.

The first end closure structure comprises a first recess or cutaway R1 struck, or defined, in part in the second lower side end closure flap 34A and struck, or defined, in part in the second upper side end closure flap 32A.

The first end closure structure comprises a second recess or cutaway R2 struck, or defined between the second upper side end closure flap 32A and the second web panel 30A.

The first end closure structure may comprise a first bottom end closure flap 36A hinged to the second base panel 20 by a hinged connection in the form of a fold line 44A.

The blank 10 comprises a second end closure structure comprising a plurality of end closure panels 22B, 24B, 26B, 28B, 28C, 30B, 32B, 34B, 36B.

The second end closure structure comprises a second upper top end closure flap 28B hingedly connected to the top panel 16 by a second fold line arrangement F2 described in further detail below. A second lower top end closure flap 28D is hingedly connected to the second upper top end closure flap 28B by a hinged connection in the form of a fold line 31B. The second upper top end closure flap 28B and the second lower top end closure flap 28D together form or define a second top end closure flap 28B/28D. The second upper top end closure flap 28B forms a proximal portion of the second top end closure flap 28B/28B disposed adjacent to the top panel 16. The second lower top end closure flap 28D forms a distal glue flap portion of the second top end closure flap 28B/28D.

The second end closure structure comprises a third upper side end closure flap 24B hingedly connected to the first side panel 14 by a hinged connection in the form of a fold line 25B.

Optionally, a third web panel 26B is hingedly connected to the second upper top end closure flap 28B along a first side edge thereof by a hinged connection in the form of a fold line 29B. The third web panel 26B may be hingedly connected to the third upper side end closure flap 24B by a hinged connection in the form of a fold line 27B.

The third upper side end closure flap 24B may be coupled to a third lower side end closure flap 22B by a third gusset panel W3.

The third lower side end closure flap 22B is hingedly connected to the first side panel 14 by a hinged connection in the form of a fold line 23B.

A first relief aperture A3 separates the third lower side end closure flap 22B from the third upper side end closure flap 24B. The first relief aperture A3 extends between the first side panel 14 and the third gusset panel W3. The first relief aperture A3 may be substantially triangular in shape, in other embodiments the first relief aperture A3 may be substantially slot shaped. The first relief aperture A3 may substantially take the form of an isosceles triangle. A vertex or corner of the first relief aperture A3 lies upon or interrupts the hinged connection between third lower side end closure flap 22B and the first side panel 14. The first relief aperture A3 is generally inclined with respect to a second side edge of the first side panel 14. A second and a third vertex of the first relief aperture A3 are disposed in closer proximity to the second upper top end closure flap 28B than the first vertex.

The second end closure structure comprises a first recess or cutaway R5 struck, or defined, in part in the third lower side end closure flap 22B and struck, or defined, in part in the third upper side end closure flap 24B.

The second end closure structure comprises a second recess or cutaway R2 struck, or defined between the third upper side end closure flap 24B and the third web panel 26B.

An optional second relief aperture A4 is provided proximate a third corner of the top panel 16. The first relief aperture A4 defines a portion of the first side edge of the second upper top end closure flap 28B, and forms a free side edge thereof. That is to say, said portion of the first side edge of the second upper top end closure flap 28B is not hinged to another panel. The relief aperture A4 spaces the third web panel 26B from the third corner of the top panel 16. The relief aperture A4 spaces apart the second upper top end closure flap 28B and the third upper side end closure flap 24B.

The second end closure structure may comprise a fourth upper side end closure flap 32B hingedly connected to the second side panel 18 by a hinged connection in the form of a fold line 37B.

Optionally, a fourth web panel 30B is hingedly connected to the second upper top end closure flap 28B along a second side edge thereof by a hinged connection in the form of a fold line 33B. The second side edge of the second upper top end closure flap 28B opposes the first side edge of the second upper top end closure flap 28B.

The fourth web panel 30B may be hingedly connected to the fourth upper side end closure flap 32B by a hinged connection in the form of a fold line 35B.

The fourth upper side end closure flap 32B may be coupled to a fourth lower side end closure flap 34B by a fourth gusset panel W4.

The fourth lower side end closure flap 34B is hingedly connected to the second side panel 18 by a hinged connection in the form of a fold line 39B.

A first relief aperture A3 separates the fourth lower side end closure flap 34B from the fourth upper side end closure flap 32B. The first relief aperture A3 extends between the second side panel 18 and the fourth gusset panel W4. The first relief aperture A3 may be substantially triangular in shape, in other embodiments the first relief aperture A3 may be substantially slot shaped. The first relief aperture A3 may substantially take the form of an isosceles triangle. A first vertex or corner of the first relief aperture A3 lies upon, or interrupts, the hinged connection between fourth lower side end closure flap 34B and the second side panel 18. The first relief aperture A3 is generally inclined with respect to a side edge of the second side panel 18. A second and a third vertex of the first relief aperture A3 are disposed in closer proximity to the second upper top end closure flap 28B than the first vertex.

An optional second relief aperture A4 is provided proximate a fourth corner of the top panel 16. The relief aperture A4 defines a portion of the second side edge of the first upper top end closure flap 28A, and forms a free side edge thereof. That is to say, said portion of the second side edge of the second upper top end closure flap 28B is not hinged to another panel. The relief aperture A4 spaces the fourth web panel 30B from the fourth corner of the top panel 16. The relief aperture A4 spaces apart the second upper top end closure flap 28B and the fourth upper side end closure flap 32B.

The second end closure structure comprises a first recess or cutaway R1 struck, or defined, in part in the fourth lower side end closure flap 34B and struck, or defined, in part in the fourth upper side end closure flap 32B.

The second end closure structure comprises a second recess or cutaway R2 struck, or defined between the fourth upper side end closure flap 32B and the fourth web panel 30B.

The second end closure structure may comprise a second bottom end closure flap 36B hinged to the second base panel 20 by a hinged connection in the form of a fold line 41B.

The blank 10 comprises a carrying handle structure H1, H2 in each of the first and second top end closure flaps 28A/28C, 28B/28D respectively. The carrying handle structures H1, H2 may be employed by a user to carry the carton 90. The first top end closure flap 28A/28C comprises a carrying handle structure H1 having a handle opening defined at least in part by a handle flap 60 struck, at least in part, from the first upper top end closure flap 28A. The handle flap 60 is hinged to the first upper top end closure flap 28A by a hinged connection in the form of a fold line 61. The handle flap 60 comprises a pair of fold lines 63, 65 (see FIG. 3) extending from the fold line 61 to an opposing side edge of the handle flap 60 so as to define a pair of foldable end portions. The pair of fold lines 63, 65 are arranged so as to diverge towards the fold line 61. The handle flap 60, including the end portions, is struck in part from the first upper top end closure flap 28*a* and in part from the first lower top end closure flap 28C. In this way the handle flap 60 and therefore the handle opening interrupt the fold line 31A hinging the first lower top end closure flap 28C to the first upper top end closure flap 28A.

Optionally, the handle flap 60 comprises a tongue 67 extending from, and defining, a portion of the opposing side edge. The tongue 67 defines a recessed or cutaway portion of the handle opening.

The first lower top end closure flap 28C or distal glue flap may be hingedly connected to the first upper top end closure flap 28A or proximal portion of the first top end closure flap 28A/28C along a glue flap fold line. The handle flap 60 may be hingedly connected to the first upper top end closure flap 28A along a handle flap fold line—fold line 61 in FIG. 1. The handle flap fold line 61 may be disposed at a higher elevation than a glue flap fold line—fold line 31A. In other words, the handle flap fold line 61 may be disposed closer to fold line 31*a* (connecting the first upper top end closure flap 28A to the top panel 16) than the glue flap fold line 31A.

The second top end closure flap 28B/28D comprises a carrying handle structure H2 which is substantially the same in construction as the first carrying handle structure H1 and will not be described in further detail.

Figure 1A:
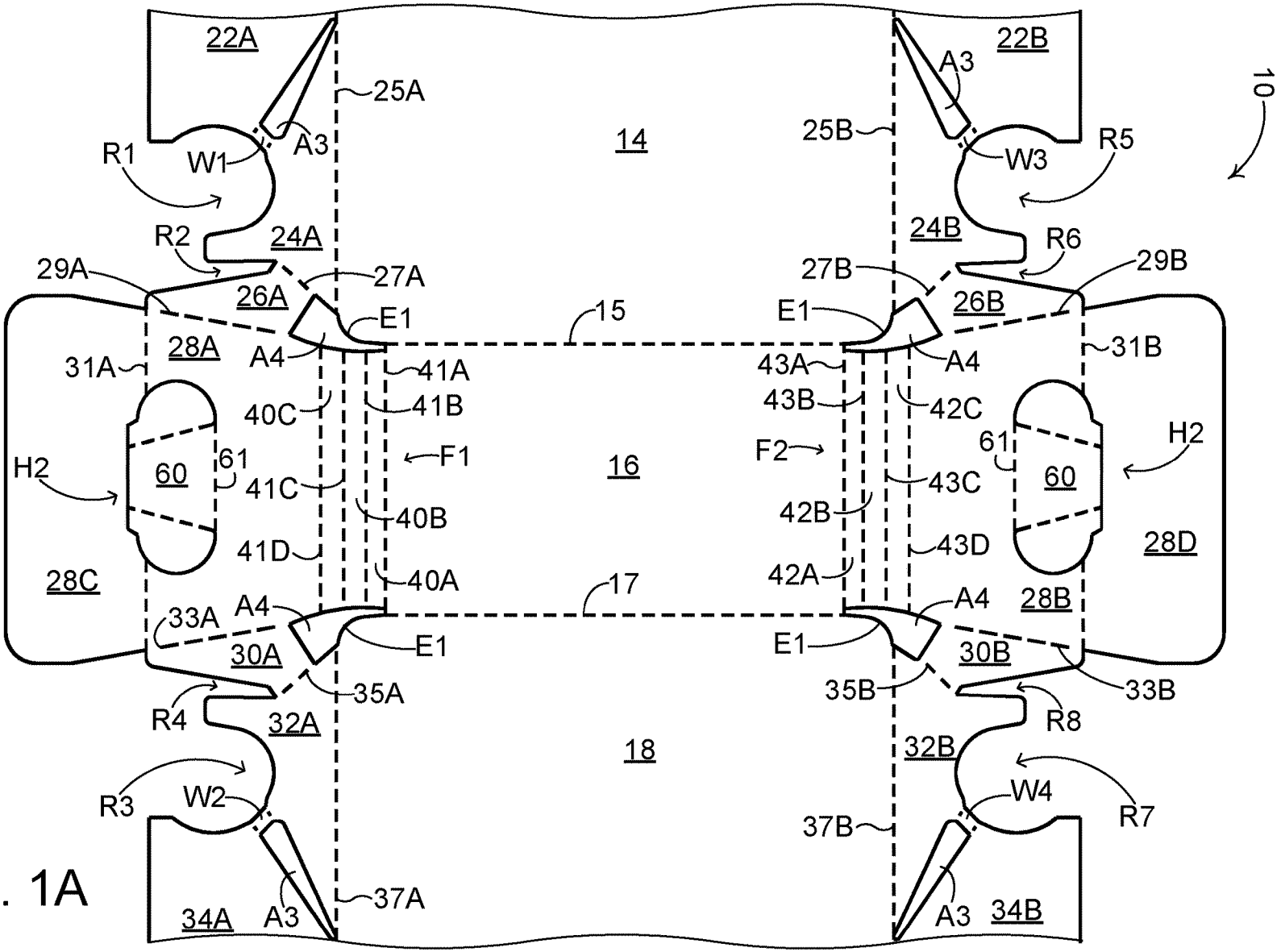
FIG. 1A is a plan view from above of a portion of the blank of FIG. 1.

The blank 10 comprises a first folding structure F1 at a first end of the top panel 16 and a second folding structure F2 at a second end of the top panel 16, best shown in FIG. 1A.

The first folding structure F1 comprises at least one first corner panel 40A, 40B, 40C. The first folding structure F1 comprises a plurality of first corner panels 40A, 40B, 40C, specifically, but not limited to, three first corner panels 40A, 40B, 40C (collectively referred to by reference sign 40 in FIG. 4). The first folding structure F1 comprises at least two fold lines 41A, 41B, 41C, 41D. The illustrated embodiment comprises four fold lines 41A, 41B, 41C, 41D. The fold lines 41A, 41B, 41C, 41D are spaced apart from each other such that pairs of fold lines 41A, 41B, 41C, 41D define, at least in part, a first corner panel 40A, 40B, 40C therebetween. The fold lines 41A, 41B, 41C, 41D may be parallel to each other.

The first folding structure F1 couples the first top end closure panel 28A/28C to the top panel 16.

The second folding structure F2 comprises at least one second corner panel 42A, 42B, 42C. The second folding structure F2 comprises a plurality of second corner panels 42A, 42B, 42C, specifically, but not limited to, three second corner panels 42A, 42B, 42C (collectively referred to by reference sign 42 in FIG. 4). The second folding structure F2 comprises at least two fold lines 43A, 43B, 43C, 43D. The illustrated embodiment comprises four fold lines 43A, 43B, 43C, 43D. The fold lines 43A, 43B, 43C, 43D are spaced apart from each other such that pairs of fold lines 43A, 43B, 43C, 43D define, at least in part, a second corner panel 42A, 42B, 42C therebetween. The fold lines 43A, 43B, 43C, 43D may be parallel to each other.

The second folding structure F2 couples the second top end closure panel 28B/28D to the top panel 16.

The second relief apertures A4 separate side edges of the first and second corner panels 40A, 40B, 40C, 42A, 42B, 42C from the first and second side panel 14, 18 and from the first and second end closure structures.

The second relief apertures A4 define rounded, or filleted, upper corners of the first and second side panels 14, 18.

Figure 4:
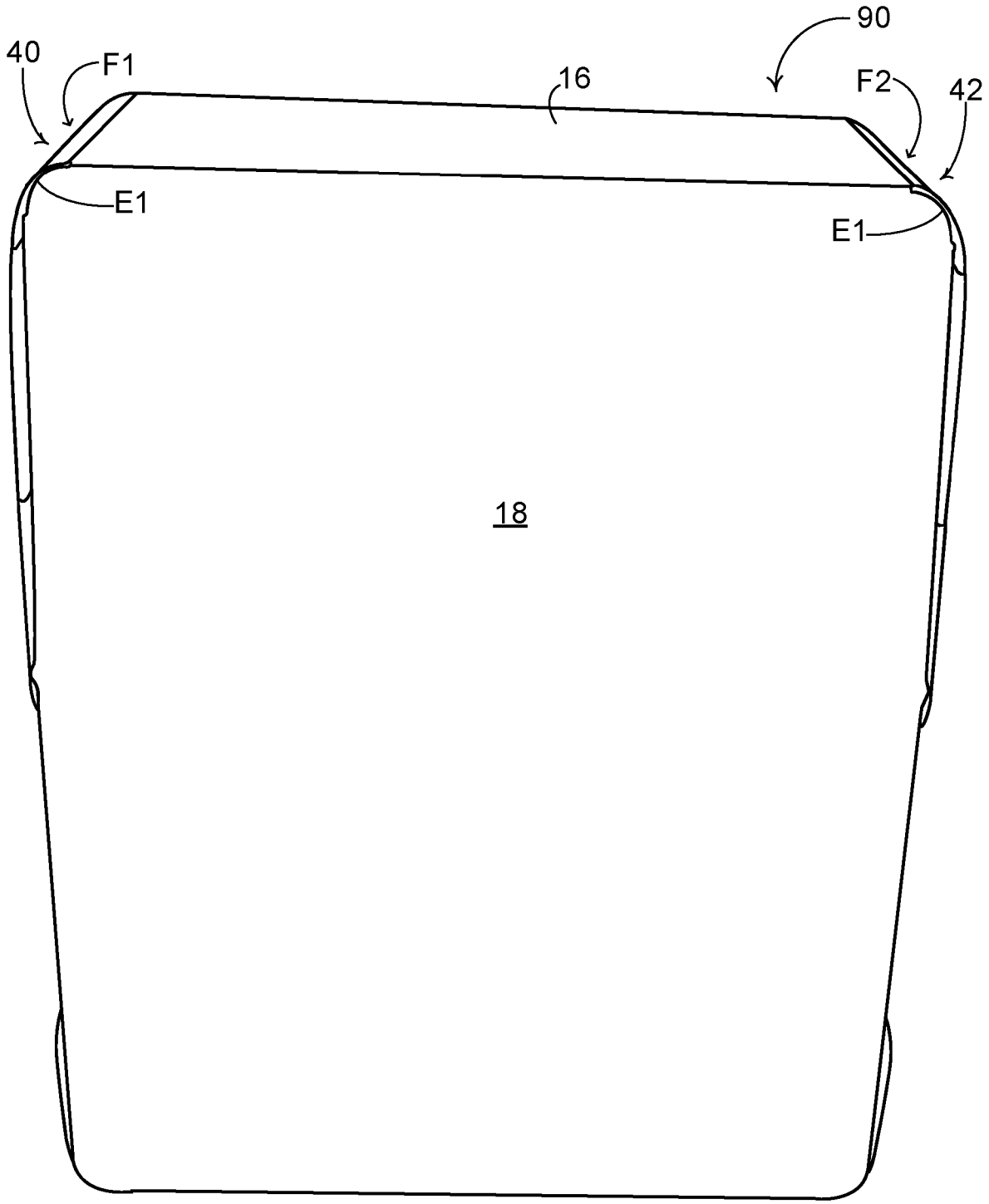
FIG. 4 is a perspective view from above of a side of the carton of FIG. 2.

In a setup carton 90 the first and second folding arrangements F1, F2 may substantially conform to the shape of the upper corners of the first and second side panels 14, 18 best illustrated in FIG. 4.

The top panel 16 comprises a first length dimension extending between a first fold line 40A of the first fold line arrangement F1 and a first fold line 42A of the second fold line arrangement F2. The first and second base panels 12, 20 comprise a second length dimension extending between free end edges of the first base panel 12 or between fold lines 44A, 44B. The second length dimension may be greater than the first length dimension.

The top panel 16 comprises a first width dimension extending between fold lines 15, 17. The second base panel 20 comprises a second width dimension. The second width dimension may be greater than the first width dimension. In some embodiments, the second width dimension may be defined by both the first and second base panels 12, 20, and may be equivalent to the sum of the widths of the first and second base panels 12, 20 minus the width of a region of overlap between the first and second base panels 12, 20.

The first and second side panels 14, 18 are each substantially rectangular in shape and comprise linear end edges. Each of the first and second side panels 14, 18 comprises a third length dimension defined between pairs of fold lines 23A/23B, 25A/25B, 37A/37B, 39A/39B. The third length dimension is equal to the second length dimension.

The fold lines 15, 17, hinging the top panel 16 to the first and second side panel 14, 18 respectively, are shorter in length than the third length dimension.

Turning to the construction of the carton 90 as illustrated in FIG. 2, the carton 90 can be formed by a series of sequential folding operations in a straight-line machine so that the carton 90 is not required to be rotated or inverted to complete its construction. The folding process is not limited to that described below and may be altered according to particular manufacturing requirements.

A group of articles is assembled; in the preferred embodiment six articles are arranged in a 3×2 array. The top panel 16 of the blank 10 is disposed above the group of articles to provide a top wall 16 of the carton 90.

The first and second panels 14, 18 are folded about the opposing sides of the group of articles; the first base panel 12 is folded about the fold line 13 so as to be disposed adjacent the base of the group of articles. The second base panel 20 is then folded about the fold line 23 so as to be in at least partial overlapping relationship with the first base panel 12. The first and second base panels 12, 20 are secured together. Each of the male tabs M is displaced inwardly out of the plane of the second base panel 20. In so doing, each of the female tabs F is displaced inwardly creating a corresponding opening in the first base panel 12. The male tabs M are received in respective ones of the openings so as to lock the first and second base panels 12, 20 together. In this way a tubular structure is formed about the group of articles.

In some embodiments, the blank 10 may be formed into a tubular structure and subsequently loaded with articles through at least one open end thereof.

Figure 3:
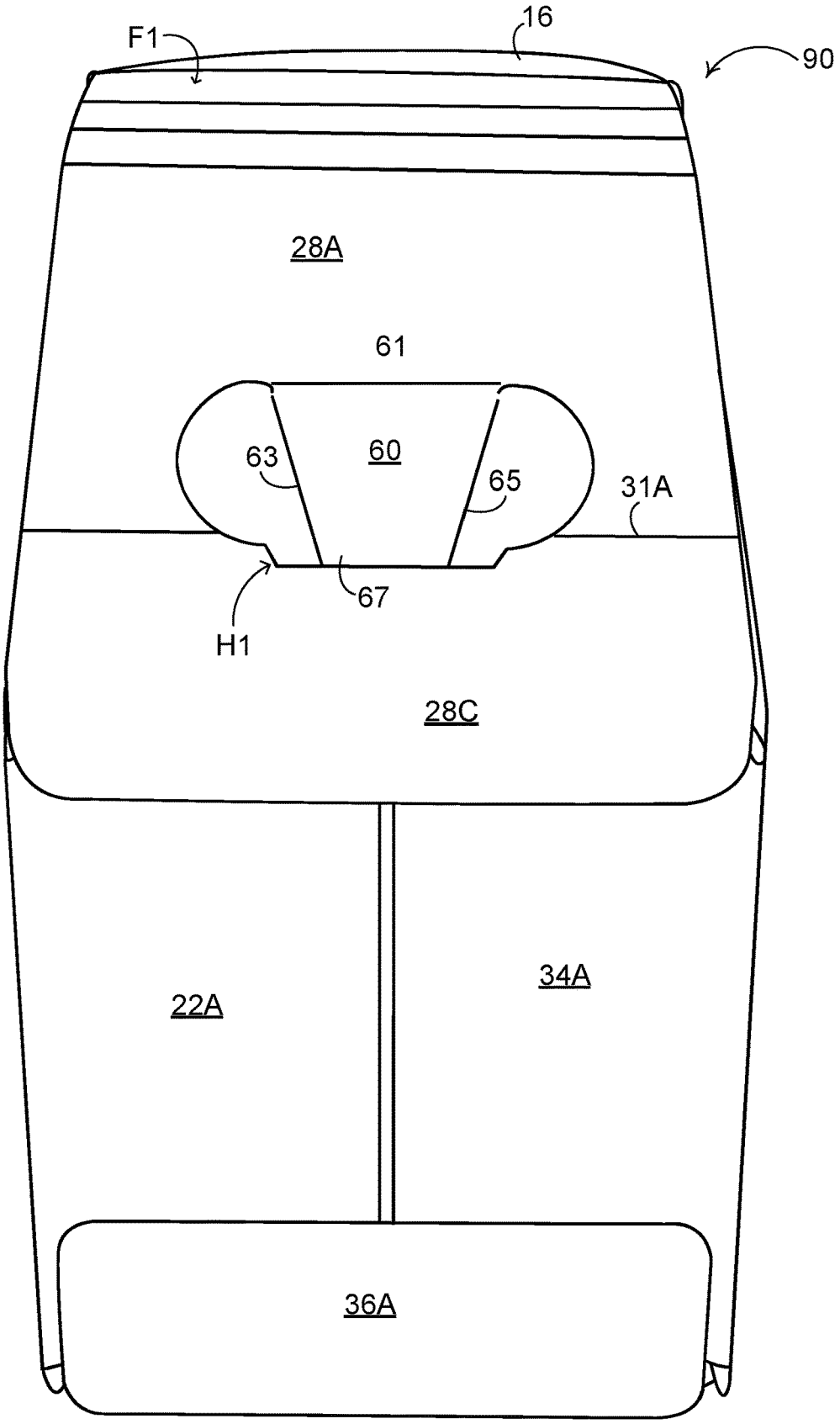
FIG. 3 is a perspective view from above of an end of the carton of FIG. 2.

The first and second end closure structures are folded about the open ends of the tubular structure. The folding sequence for each of the first and second end closure structures is substantially the same and will be described in more detail by reference to the first end closure structure only as illustrated in FIGS. 2 and 3.

The first and second upper side end closure flaps 24A, 32A and the first and second lower side end closure flaps 22A, 34A are folded about the fold lines 23A, 25A, 37A, 39A so as to partially close the first open end of the tubular structure.

As a consequence of folding first and second upper side end closure flaps 24A, 32A inwardly about the fold lines 25A, 37A the first top end closure flap 28A/28C is folded downwardly.

The first and second upper side end closure flaps 24A, 32A and the first and second lower side end closure flaps 22A, 34A are folded inwardly so as to be brought into close proximity or contact with the endmost articles in the carton 90. The first web panel 26A and the second web panel 30A are folded into face to face relationship with the respective one of first and second upper side end closure flaps 24A, 32A, such that a first surface each of the first and second web panels 26A, 30A faces a first surface of the respective one of the first and second upper side end closure flaps 24A, 32A.

It will be appreciated that the sheet material comprises a first surface and a second surface. The first surface may be a coated, printed or otherwise finished surface. The second surface may be an uncoated surface typically referred to in the art as a "brown side". The folding arrangement is such that the disposition of the respective one of the first and second surfaces of the sheet material provided by the first and second web panels 26A, 30A is reversed in orientation with respect to the first and second surfaces of the sheet material provided by the first top end closure panel 28A/28C, first and second upper side end closure flaps 24A, 32A and the first and second lower side end closure flaps 22A, 34A. In other words the coated, printed or otherwise finished surface of the first top end closure panel 28A/28C, first and second upper side end closure flaps 24A, 32A and the first and second lower side end closure flaps 22A, 34A faces outwardly of the interior of the carton 90 whereas the brown side of first and second web panels 26A, 30A faces outwardly of the interior of the carton 90.

The first upper top end closure flap 28A is folded downwardly such that a second surface thereof is brought into close proximity, or contact, with and faces a second surface of the respective one of first and second upper side end closure flaps 24A, 32A.

The first and second web panels 26A, 30A are disposed between the first upper top end closure flap 28A and the respective one of first and second upper side end closure flaps 24A, 32A to which they are hingedly connected.

The first top end closure flap 28A/28C is secured to the first and second upper side end closure flaps 24A, 32A.

The first lower top end closure flap 28C is folded upwardly—out of, or away from, an end closing position—with respect to the first upper top end closure flap 28A about the fold line 31A. In this way the lower portions of the first and second upper side end closure flaps 24A, 32A are exposed.

The tongue 67 of the handle flap 60 serves as a retention member, holding each of the first and second lower side end closure flaps 22A, 34A in their folded positions. The tongue 67 of the handle flap 60 is disposed in overlying or overlapping relationship with the first and second lower side end closure flaps 22A, 34A.

The tongue 67 engages with a projection or lobe of the first and second lower side end closure flaps 22A, 34A.

Glue G or other adhesive treatment may be applied to the outer surface of the lower portions of the first and second upper side end closure flaps 24A, 32A. Alternatively, glue or other adhesive treatment may be applied to the inner surface of the first lower top end closure flap 28C.

The first lower top end closure flap 28C is folded downwardly—into, or towards, an end closing position—with respect to the first upper top end closure flap 28A about the fold line 31A and is brought into face contacting relationship with the lower portions each of the first and second upper side end closure flaps 24A, 32A so as to secure them together.

Glue or other adhesive treatment may be applied to the first and second lower side end closure flaps 22A, 34A or to the first bottom end closure flap 36A.

The first bottom end closure flap 36A is folded about fold line 44A so as to be brought up into face contacting relationship with the first and second lower side end closure flaps 22A, 34A.

The first bottom end closure flap 36A is secured to the first and second lower side end closure flaps 22A, 34A.

The assembled carton 90 is shown in FIG. 2.

The present disclosure provides a carton 90 for packaging articles. The carton 90 comprises a plurality of panels 12, 14, 16, 18, 20 forming walls of a tubular structure including a top wall 16, a first side wall 14, a base wall 12/20, and a second side wall 18, optionally hingedly connected to each other in a linear series.

The carton 90 comprises first and second folding structures F1, F2 which is folded or tightened so as to bear against the endmost articles so as to prevent or inhibit movement of the articles. For example, portions of the corner panels 40A, 40B, 40C, 42A, 42B, 42C, may bear against a respective one the endmost articles.

The corner panels 40A, 40B, 40C, 42A, 42B, 42C may be arranged to bear against, a cap or closure portion at an upper end of an adjacent article.

Upper regions of the side walls 14, 18 folded or displaced inwardly with respect to lower regions thereof so as to bear against, shoulder portions or neck portion adjacent articles.

The carton 90 comprises an end closure structure for partially closing an end of the carton 90. The end closure structure comprises a top end closure flap 28A/28C, 28B/28D hingedly connected to the top panel 16 by at least one corner panel 40, 42. At least one side end closure flap 22A, 24A, 32A, 34A, 22B, 24B, 32B, 34B hinged to one of the first and second side walls 14, 18, wherein the at least one side end closure flap 22A, 24A, 32A, 34A, 22B, 24B, 32B, 34B is arranged to be securable to the top end closure flap 28A/28C, 28B/28D.

The end closure structure may be configured and arranged such that the top end closure flap 28A/28C, 28B/28D is folded automatically in response to folding an upper side end closure flap 24A, 32A, 24B, 32B. The end closure structure may comprise a web panel 26A, 30A, 26B, 30B coupling the top end closure flap 28A/28C, 28B/28D to the upper side end closure flap 24A, 32A, 24B, 32B.

The top wall 16 of the carton 90 may be shorter than the base wall 12/20 in a longitudinal direction parallel to a tubular axis of the tubular structure formed by the plurality of main panels 12, 14, 16, 18, 20.

The top wall 16 of the carton 90 may be shorter than the base wall 12/20 in a transverse direction perpendicular to the tubular axis of the tubular structure formed by the plurality of main panels 12, 14, 16, 18, 20.

The first upper side end closure flap 24A and the first lower side end closure flap 22A together define a first side end closure flap 22A/24A or dust flap 22A/24A. Similarly, the second, third, and fourth upper and lower side end closure flaps 32A, 34A, 22B, 24B, 32B, 34B define respective second, third, and fourth side end closure flaps 32A/34A, 22B/24B, 32B/34B or second, third, and fourth dust flaps 32A/34A, 22B/24B, 32B/34B.

The first, second, third, and fourth dust flaps 22A/24A, 32A/34A, 22B/24B, 32B/34B each comprise a slot A3 which is defined by a pair of opposing longitudinal edge both sloping downwardly toward the fold line 23A/25A, 37A/39A, 23B/25B, 37B/39B hinging said dust flap 22A/24A, 32A/34A, 22B/24B, 32B/34B to a respective one of the first and second side walls 14, 18.

The slot A3 may be defined by a pair of opposing longitudinal edges at least one of which is sloping downward toward an entirely linear fold line 23A/25A, 37A/39A, 23B/25B, 37B/39B. That is to say a fold line 23A, 39A, 23B, 39B hinging one of lower side end closure flaps 22A, 34A, 22B, 34B to one of the first and second side walls 14, 18 is colinear with a fold line 25A an adjacent upper side end closure flap 24A, 32A, 24B, 32B to said one of the first and second side walls 14, 18.

The present disclosure provides a carton 90 comprising a plurality of primary panels 12, 14, 16, 18, 20 for forming a tubular structure and an end closure structure for at least partially closing an end of the tubular structure. The primary panels 12, 14, 16, 18, 20 include a top panel 16. The end closure structure comprises a top end closure flap 28A/28C having a handle opening, a first side end closure flap 24A, and a web panel 26A coupling the top end closure flap 28A/28C with the first side end closure flap 24A. The web panel 26A is hingedly connected to the top end closure flap 28A/28C as well as to the first side end closure flap 24A. The top end closure flap 28A/28C is connected to the top panel 16 by at least one corner panel 40A, 40B, 40C.

The present disclosure also provides a carton 90 for packaging articles comprising a plurality of primary panels 12, 14, 16, 18, 20 for forming a tubular structure and an end closure structure for at least partially closing an end of the tubular structure. The primary panels 12, 14, 16, 18, 20 include a top panel 16. The end closure structure comprises a top end closure flap 28A/28C, a first side end closure flap 24A and a web panel 26A coupling the top end closure flap 28A/28C with the first side end closure flap 24A. The web panel 26A is hingedly connected to the top end closure flap 28A/28C as well as to the first side end closure flap 24A. The top end closure flap 28A/28C is connected to the top panel 16 by at least one corner panel 40A, 40B, 40C. The top end closure flap 28A/28C is disposed at least partially overlaying an outside surface of the first side end closure flap 24A.

The present disclosure further provides a carton 90 for packaging articles comprising a plurality of primary panels 12, 14, 16, 18, 20 for forming a tubular structure and an end closure structure for at least partially closing an end of the tubular structure. The primary panels 12, 14, 16, 18, 20 include a top panel 16. The end closure structure comprises a top end closure flap 28A/28C, a first side end closure flap 24A and a web panel 26A coupling the top end closure flap 28A/28C with the first side end closure flap 24A. The web panel 26A is hingedly connected to the first side end closure flap 24A by a first fold line 27A. The top end closure flap 28A/28C is connected to the top panel 16 by at least one corner panel 40A, 40B, 40C which has at least one intermediate fold line 41A, 41B, 41C, 41D extending at least partially across the corner panel 40A, 40B, 40C. The at least one intermediate fold line 41A, 41B, 41C, 41D is disposed at an acute angle with respect to the first fold line 27A.

The present disclosure also provides a carton 90 comprising a plurality of primary panels 12, 14, 16, 18, 20 for forming a tubular structure and an end closure structure for at least partially closing an end of the tubular structure. The primary panels include a top panel 16 and a first side panel 14. The end closure structure comprises a top end closure flap 28A/28C, a first side end closure flap 24A and a web panel 26A coupling the top end closure flap 28A/28C with the first side end closure flap 24A. The web panel 26A is hingedly connected to the top end closure flap 28A/28C as well as to the first side end closure flap 24A. The top end closure flap 28A/28C is connected to the top panel 16 by at least one corner panel 40A, 40B, 40C. The side panel 14 has a rounded corner edge E1 along which the at least one corner panel 40A, 40B, 40C is conformingly disposed.

It can be appreciated that various changes may be made within the scope of the present invention. For example, the size and shape of the panels and apertures may be adjusted to accommodate articles of differing size or shape. In alternative embodiments the web panels 26A, 26B, 30A, 30B may be omitted.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A carton for packaging one or more articles comprising a plurality of panels forming walls of a tubular structure, the walls comprising first and second side walls, the plurality of panels comprising a top panel, and an end closure structure for at least partially closing an end of the tubular structure, the end closure structure comprising:

a top end closure flap comprising a handle structure which defines at least in part a handle opening in the top end closure flap for forming a carrying handle;

a side end closure flap coupled to one of the first and second side walls; and a web panel coupling the top end closure flap to the side end closure flap, the web panel being hingedly connected to the top end closure flap and being hingedly connected to the side end closure flap, wherein the top end closure flap is connected to the top panel by at least one corner panel, wherein the plurality of panels comprises a first side panel for forming the first side wall, wherein the first side panel has a rounded corner edge along which the at least one corner panel is conformingly disposed.

2. A carton according to claim 1 comprising a folding structure coupling the top end closure flap to the top panel, the folding structure including the at least one corner panel, the folding structure being folded so as to bear against at least one article disposed adjacent thereto so as to inhibit movement of the at least one article.

3. A carton according to claim 1 wherein the at least one corner panel is configured to bear against an upper end of an adjacent article.

4. A carton according to claim 1 wherein an upper region of each of the first and second side walls is displaced inwardly with respect to a lower region of the respective first and second side wall.

5. A carton according to claim 1 wherein the walls comprise a top wall comprising the top panel and a base wall, wherein the top wall is shorter than the base wall in a longitudinal direction parallel to a tubular axis of the tubular structure.

6. A carton according to claim 1 wherein the walls comprise a top wall comprising the top panel and a base wall, wherein the top wall of the carton is shorter than the base wall in a transverse direction perpendicular to a tubular axis of the tubular structure.

7. A carton according to claim 1 wherein the side end closure flap comprises a first upper portion and a first lower portion together defining a dust flap.

8. A carton according to claim 7 wherein the first lower portion is at least partially separated from the first upper portion, wherein each of the first lower portion and the first upper portion being hingedly connected to the first side wall by respective fold lines that are colinear.

9. A carton according to claim 7, wherein the first lower portion is partially separated from the first upper portion by a relief aperture.

10. A carton according to claim 1 wherein the side end closure flap comprises a slot which is defined by a pair of opposing longitudinal edges both sloping downwardly toward a fold line that hinges said side end closure flap to said one of the first and second side walls.

11. A carton according to claim 1 comprising a second end closure structure for at least partially closing a second end of the tubular structure, the second end closure structure comprising a second side end closure flap hingedly connected to a second end of said one of the first and second side walls.

12. A carton according to claim 11 wherein the second side end closure flap comprises a second upper side end closure flap and a second lower side end closure flap together defining a second dust flap.

13. A carton according to claim 11 wherein the second side end closure flap comprises a slot which is defined by a second pair of opposing longitudinal edges both sloping downwardly toward a second fold line that hinges said second side end closure flap to said one of the first and second side walls.

14. A carton according to claim 1 wherein the side end closure flap is hingedly connected to the first side wall by a linear fold line extending between corner regions of the first side wall.

15. A carton for packaging one or more articles comprising a plurality of panels for forming walls of a tubular structure, the plurality of panels including a top panel, the carton comprising an end closure structure for at least partially closing an end of the tubular structure, the end closure structure comprising:

a top end closure flap;

a side end closure flap; and a web panel, the web panel coupling the top end closure flap to the side end closure flap, the web panel being hingedly connected to the top end closure flap and being hingedly connected to the side end closure flap, wherein the top end closure flap is connected to the top panel by at least one corner panel, wherein the top end closure flap is disposed at least partially overlaying an outside surface of the side end closure flap, and wherein the plurality of panels comprise a first side panel, wherein the first side panel has a rounded corner edge along which the at least one corner panel is conformingly disposed.

16. A carton according to claim 15, wherein the at least one corner panel comprises at least one intermediate fold line extending at least partially across the corner panel, and wherein the at least one intermediate fold line is disposed at an acute angle with respect to a first fold line.

17. A blank for forming a carton, the blank comprising a plurality of panels for forming walls of a tubular structure, the walls comprising first and second side walls, the plurality of panels comprising a top panel, and an end closure structure for at least partially closing an end of the tubular structure, the end closure structure comprising:

a top end closure flap comprising a handle structure which defines at least in part a handle opening in the top end closure flap for forming a carrying handle;

a side end closure flap coupled to one of the first and second side walls; and a web panel coupling the top end closure flap to the side end closure flap, the web panel being hingedly connected to the top end closure flap and being hingedly connected to the side end closure flap, wherein the top end closure flap is connected to the top panel by at least one corner panel, wherein the plurality of panels comprises a first side panel for forming the first side wall, wherein the first side panel has a rounded corner edge along which the at least one corner panel is conformingly disposed.

18. A blank according to claim 17, wherein the side end closure flap comprises a first upper portion and a first lower portion, wherein the first lower portion is at least partially separated from the first upper portion, wherein each of the first lower portion and the first upper portion are configured to be hingedly connected to the first side wall by respective fold lines that are colinear.

19. A blank according to claim 18, wherein the first lower portion is partially separated from the first upper portion by a relief aperture.

20. A blank for forming a carton, the blank comprising a plurality of panels for forming walls of a tubular structure, the plurality of panels comprising a top panel, and an end closure structure for at least partially closing an end of the tubular structure, the end closure structure comprising:

a top end closure flap;

a side end closure flap; and a web panel, the web panel coupling the top end closure flap to the side end closure flap, the web panel being hingedly connected to the top end closure flap and being hingedly connected to the side end closure flap, wherein the top end closure flap is connected to the top panel by at least one corner panel, wherein the top end closure flap is arranged to be disposed at least partially overlaying an outside surface of the first side end closure flap in a setup carton; and wherein the plurality of panels comprise a first side panel, wherein the first side panel has a rounded corner edge along which the at least one corner panel is conformingly disposed.

21. A blank according to claim 20 wherein the at least one corner panel comprises at least one intermediate fold line extending at least partially across the corner panel, and wherein the at least one intermediate fold line is disposed at an acute angle with respect to a first fold line.

* * * * *